US011220879B2

(12) United States Patent
Kræmer

(10) Patent No.: US 11,220,879 B2
(45) Date of Patent: Jan. 11, 2022

(54) PLUG AND PLUG AND ABANDONMENT SYSTEM

(71) Applicant: Welltec Oilfield Solutions AG, Zug (CH)

(72) Inventor: Jon Kræmer, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 265 days.

(21) Appl. No.: 16/215,995

(22) Filed: Dec. 11, 2018

(65) Prior Publication Data

US 2019/0178049 A1 Jun. 13, 2019

(30) Foreign Application Priority Data

Dec. 12, 2017 (EP) ..... 17206810
May 30, 2018 (EP) ..... 18175170

(51) Int. Cl.
*E21B 33/12* (2006.01)
*E21B 33/134* (2006.01)
(Continued)

(52) U.S. Cl.
CPC ..... *E21B 33/1204* (2013.01); *E21B 23/02* (2013.01); *E21B 33/1277* (2013.01);
(Continued)

(58) Field of Classification Search
CPC ..... E21B 43/103–108; E21B 17/14
See application file for complete search history.

(56) References Cited

U.S. PATENT DOCUMENTS 3,053,322 A * 9/1962 Kline ..... E21B 33/14 277/333
4,292,988 A * 10/1981 Montgomery ..... E21B 21/10 137/68.17
(Continued)

FOREIGN PATENT DOCUMENTS

EP 2 565 365 3/2013
EP 2 570 588 3/2013
(Continued)

OTHER PUBLICATIONS

Extended European Search Report for EP Patent Application No. 17206810.8 dated May 28, 2018, 7 pages.
(Continued)

*Primary Examiner* — Blake Michener
(74) *Attorney, Agent, or Firm* — Nixon & Vanderhye P.C.

(57) ABSTRACT

The present invention relates to an abandonment plug for plug and abandonment of a well, said abandonment plug comprising a first end part being closable or closed, a second end part being tubular and having a groove in an inner face, an expandable metal sleeve arranged between the end parts, the end parts being more rigid than the expandable metal sleeve, and an unit releasably connected to the second tubular end part, the unit comprising at least one radially projectable fastening element, a unit sleeve, and a piston movable in the unit sleeve for, in a first position, forcing the radially projectable fastening element and, in a second position, being offset in relation to the radially projectable fastening element, allowing the radially projectable fastening element to move radially inwards. Furthermore, the present invention relates to a plug and abandonment system comprising the abandonment plug according to the present invention.

17 Claims, 12 Drawing Sheets

Figure 1A:
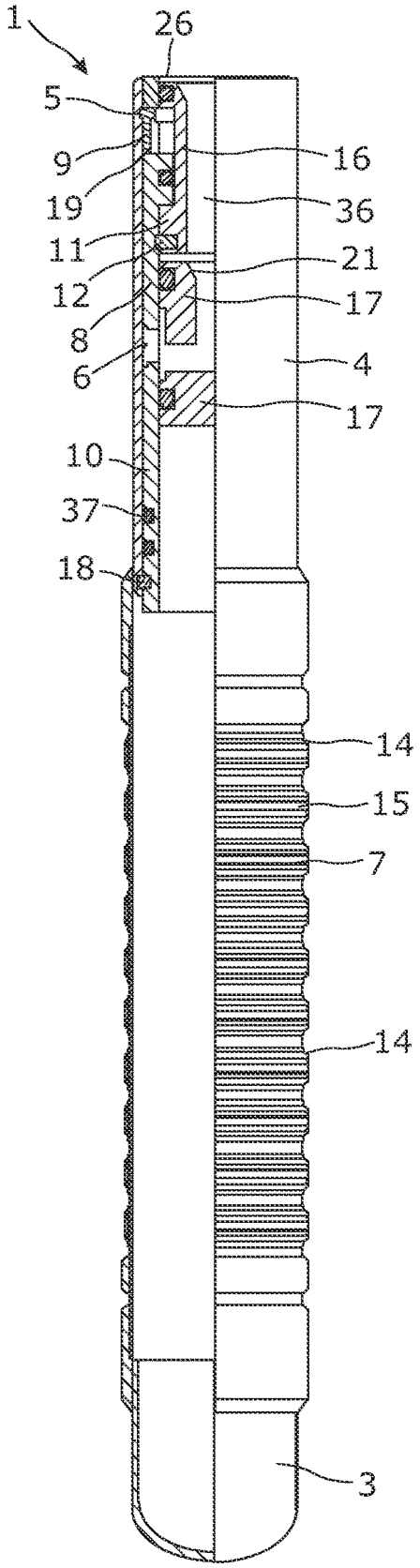

(51) Int. Cl.

| | |
|---|---|
| ***E21B 33/128*** | (2006.01) |
| ***E21B 33/127*** | (2006.01) |
| ***E21B 43/10*** | (2006.01) |
| ***E21B 23/02*** | (2006.01) |

(52) U.S. Cl.
CPC ..... *E21B 33/1285* (2013.01); *E21B 33/134* (2013.01); *E21B 43/103* (2013.01)

(56) References Cited

U.S. PATENT DOCUMENTS

| | | | | |
|---|---|---|---|---|
| 4,360,063 | A * | 11/1982 | Kilgore | E21B 23/08 166/313 |
| 2004/0069485 | A1 | 4/2004 | Ringgengberg et al. | |
| 2007/0034386 | A1 | 2/2007 | Hemy | |
| 2014/0145402 | A1* | 5/2014 | Hallundaek | E21B 43/103 277/334 |
| 2014/0158371 | A1* | 6/2014 | Hallundbaek | E21B 43/10 166/377 |
| 2016/0024896 | A1* | 1/2016 | Johnson | E21B 43/108 166/302 |

FOREIGN PATENT DOCUMENTS

| | | |
|---|---|---|
| EP | 2 947 259 | 11/2015 |
| EP | 3 205 812 A1 | 8/2017 |
| WO | WO 2014/137314 A1 | 9/2014 |

OTHER PUBLICATIONS

International Preliminary Report on Patentability dated Jun. 16, 2020 in International Application No. PCT/EP2018/084275, 7 pages.
International Search Report and Written Opinion of the International Searching Authority dated Apr. 4, 2019 in International Application No. PCT/EP2018/084275, 9 pages.

* cited by examiner

PLUG AND PLUG AND ABANDONMENT SYSTEM

This application, which designated the U.S. and claims priorities to EP 17206810.8 filed Dec. 12, 2017 and EP 18175170.2 filed May 30, 2018, the entire contents of each of which are hereby incorporated by reference.

The present invention relates to an abandonment plug for plug and abandonment of a well and to a plug and abandonment system.

When a well becomes less productive, and all attempts to improve the production of hydrocarbons from a reservoir have failed, the unproductive part of the well, if not the whole well, is plugged and abandoned. Plug and abandonment is an important part of the lifetime of a well. It is also a costly process since the authorities have high requirements for the plugging operations in order to ensure that the well does not pollute the environment. Most regulatory bodies require that cement plugs are placed and tested across any open hydrocarbon-bearing formation, across all casing shoes, across freshwater aquifers, and perhaps across several other areas near the surface, including the top 6 to 15 m of the wellbore. The well designer often chooses to set bridge plugs in conjunction with cement slurries to ensure that higher density cement does not fall to long into the wellbore. In that case, the bridge plug would be set and cement pumped on top of the plug through a drill pipe string, and then the drill pipe string would be withdrawn before the slurry thickened. In other situations, the plug is set and cement is pumped down through the plug, and thus the cement is arranged underneath the plug before the plug is permanently closed for flow-through. Most of the plugs have complex designs for providing flow-through during insertion of the plug, and thus the plugs are provided with shear pins, pistons, sealing arrangement etc.

When planning a well, costs for plug and abandonment have to be guaranteed, so that the authorities are not left with a large bill to pay for the plug and abandonment of the well, and thus a well operator always seek a less expensive solution for plug and abandonment so that less money is to be guaranteed. However, known plugs are expensive and some fail due to the complexity of the plug to provide flow-through, and subsequently the plug cannot close as intended and a new plug has to be inserted.

It is an object of the present invention to wholly or partly overcome the above disadvantages and drawbacks of the prior art. More specifically, it is an object to provide an improved plug and abandonment system which is less complex and costly than known solutions.

The above objects, together with numerous other objects, advantages and features, which will become evident from the below description, are accomplished by a solution in accordance with the present invention by an abandonment plug for plug and abandonment of a well, said abandonment plug comprising:

- a first end part being closable or closed,
- a second end part being tubular and having a groove in an inner face,
- an expandable metal sleeve arranged between the end parts, the end parts being more rigid than the expandable metal sleeve, and
- a unit releasably connected to the second tubular end part, the unit comprising:
  - at least one radially projectable fastening element,
  - a unit sleeve, and
  - a piston movable in the unit sleeve for, in a first position, forcing the radially projectable fastening element and, in a second position, being offset in relation to the radially projectable fastening element, allowing the radially projectable fastening element to move radially inwards.

The abandonment plug according to the present invention may further comprise a first breakable element for maintaining the piston in the first position in relation to the unit sleeve until the breakable element breaks at a predetermined force.

Moreover, the expandable metal sleeve may be mounted end-to-end to the first and second end parts.

Also, the expandable metal sleeve may be the only element connecting the first end part and the second end part.

Further, the expandable metal sleeve may have circumferential projections.

In addition, the expandable metal sleeve may have a sealing element arranged between two projections.

Furthermore, the piston may be tubular.

Additionally, the piston may have a first piston part and a second piston part which are movable in relation to each other.

Moreover, the first piston part may be tubular and the second part may be bore-less.

In addition, the unit releasably connected to the second tubular end part may be an expansion unit aiding the expansion of the expandable metal sleeve.

The abandonment plug according to the present invention may further comprise a second breakable element between the unit sleeve and the second end part for maintaining the unit sleeve in the first position in relation to the second end part until the breakable element breaks at a predetermined force.

Also, the unit sleeve may have a unit groove in which the radially projectable fastening element is arranged.

The unit sleeve may comprise sealing elements arranged between the unit sleeve and the second end part.

Further, the piston may have a ball seat for receiving a ball dropped into the well.

In addition, the second end part may have an opening for receiving a wiper dart or ball to close the second end part.

Moreover, the second end part may have a closing unit for closing the opening. The closing unit may comprise a tubular unit part having a first unit end being open and a second unit end being closed, a sliding sleeve arranged on an outer face of the tubular unit part defining a chamber, at least one first opening in the tubular unit part, at least one second opening in the tubular unit part opposite the chamber, the at least one second opening is arranged closer to the first unit end than the at least one first opening, and a ball seat arranged in the tubular unit part between the at least one first opening and the at least one second opening.

The sliding sleeve in the first position may uncover the at least one first opening and the sliding sleeve in the second position may cover the at least one first opening.

Furthermore, the sliding sleeve may move from the first position to the second position by means of fluid entering the chamber, which increases as the sliding sleeve moves away from the first unit end.

Also, the sliding sleeve may function as a piston.

Moreover, the closing unit may comprise at least one shear pin for maintaining the sleeve in the first position until a predetermined pressure.

In addition, the outer face at the second unit end may comprise circumferential grooves engaging a pawl of an end part of the sliding sleeve in the form of a ratchet system.

Further, the sliding sleeve may comprise an opening which in the first position is aligned with the at least one first opening in the tubular unit part.

The closing unit may further comprise a first sealing means and a second sealing means arranged between the sliding sleeve and the tubular unit part on each side of the at least first opening, and a third sealing means arranged between the sliding sleeve and the tubular unit part between the first unit end and the at least second opening.

The abandonment plug according to the present invention may further comprise a unit housing surrounding the tubular unit part and the sliding sleeve, in order that the sliding sleeve slides between the unit housing and the tubular unit part.

The abandonment plug may further comprise an end cap having apertures and being connected to the unit housing.

Moreover, the unit housing may comprise a projection on an inner face for receiving a flange of the tubular unit part in order that the tubular unit part is hindered from movement past the projection.

Also, the tubular unit part may have a third unit section having a third outer diameter being greater than the second outer diameter.

In addition, the third outer diameter may be greater than the outer diameter of the second sleeve part creating space for the second sleeve part to be allowed to slide.

Furthermore, the second sleeve part may be allowed to slide until reaching the projection.

Moreover, the outer diameter of the first sleeve part may be smaller than the inner diameter of the projection so that the first sleeve part is allowed to freely slide past the projection.

Furthermore, the at least one second opening may have a diameter smaller than that of the at least one first opening.

Further, the sliding sleeve may have a first sleeve part having a first inner sleeve diameter and a second sleeve part having a second inner sleeve diameter, the tubular unit part having a first unit section having a first outer diameter corresponding to the first inner sleeve diameter and a second unit section of the tubular unit part having a second outer diameter corresponding to the second inner sleeve diameter.

Additionally, the tubular unit part may have a decreasing inner diameter at the first unit end for guiding a ball towards the ball seat.

Also, the tubular unit part may be mounted within the unit housing.

Furthermore, the plug may be connected to a workover pipe, drill pipe, coiled tubing or similar disconnectable tubing.

Moreover, the unit sleeve may have a through-bore in which the piston slides.

Further, the abandonment plug may comprise a venting port in the second tubular end part for equalising the pressure within well while running in the plug.

Furthermore, the abandonment plug may comprise a base part connecting the first end part and the second end part.

In addition, the base part may be surrounded of the expandable metal sleeve.

Moreover, the base part may have an opening.

The present invention also relates to a plug and abandonment system comprising the abandonment plug according to the present invention and a cement supply for supplying cement above the plug, below the plug and/or in the plug.

Additionally, the plug may be releasably connected to a workover pipe, drill pipe, coiled tubing or similar disconnectable tubing.

The plug and abandonment system according to the present invention may further comprise a stroking tool connected to the unit for providing an axial force for expanding the expandable metal sleeve.

Said plug and abandonment system according to the present invention may furthermore comprise diconnectable tubing connecting the cement supply with the plug.

Figure 2A:
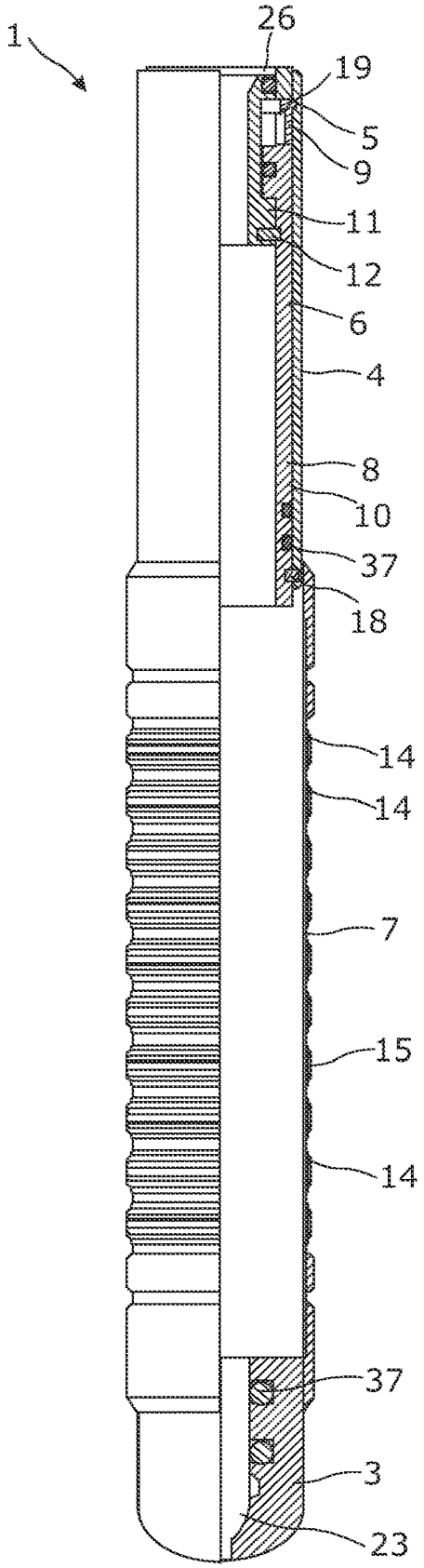
Figure 2B:
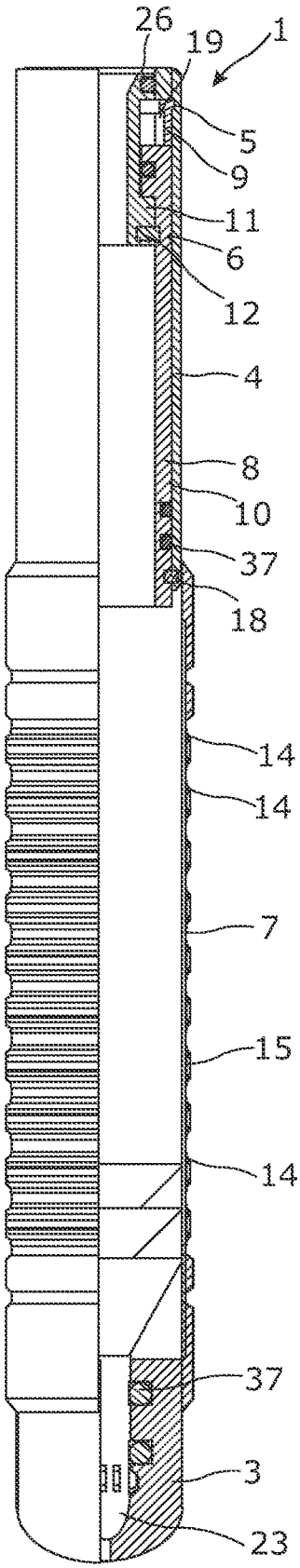
Figure 2C:
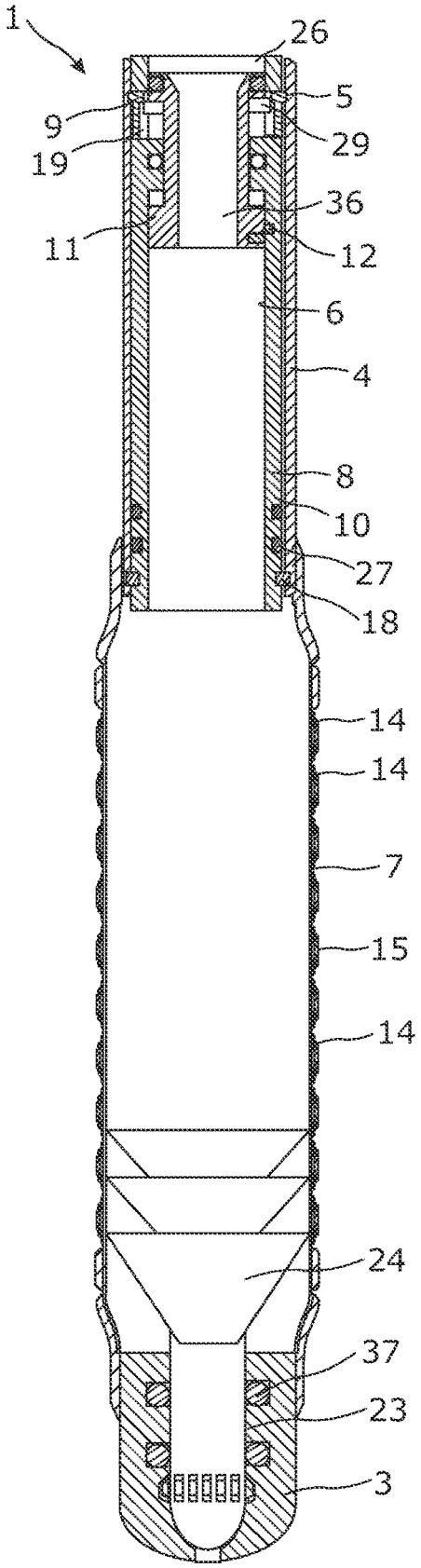
Figure 2D:
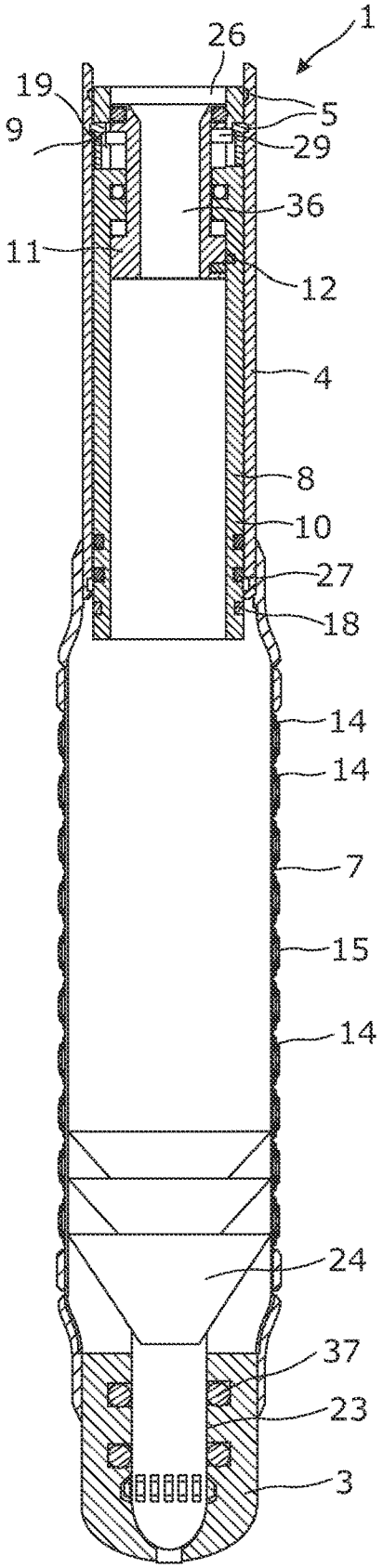
Figure 2E:
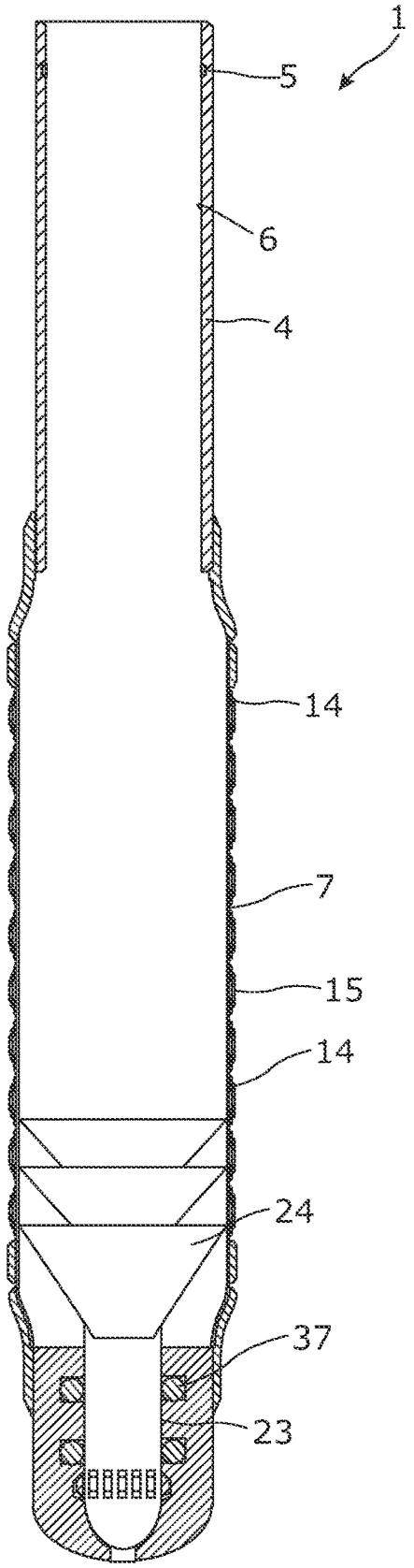
Figure 3A:
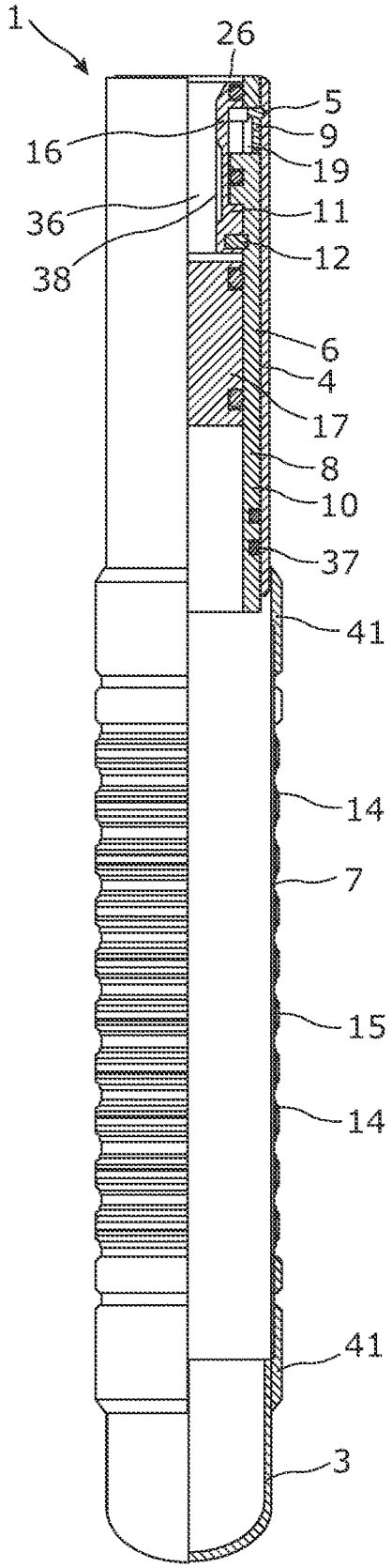
Figure 3B:
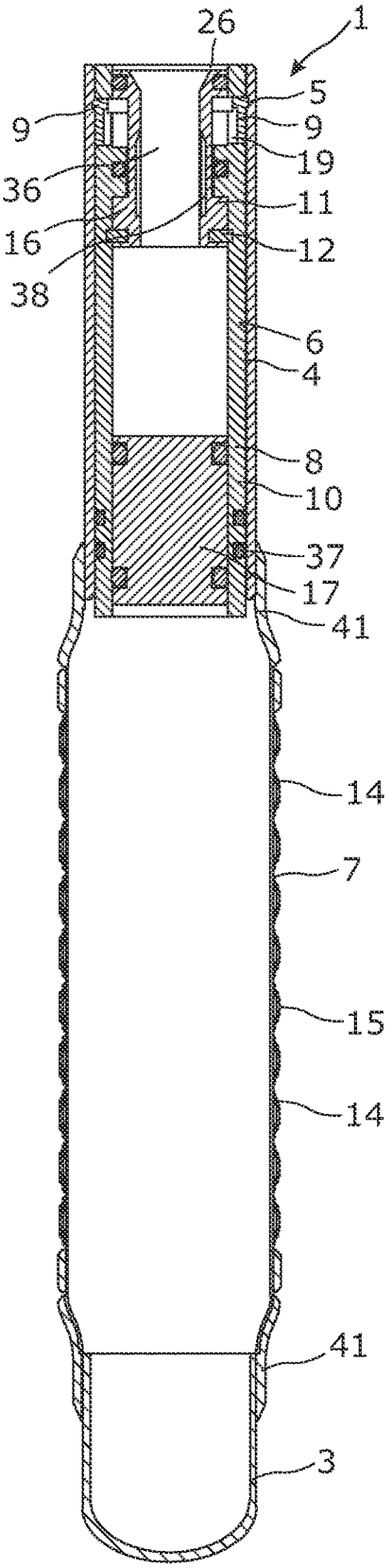
Figure 3C:
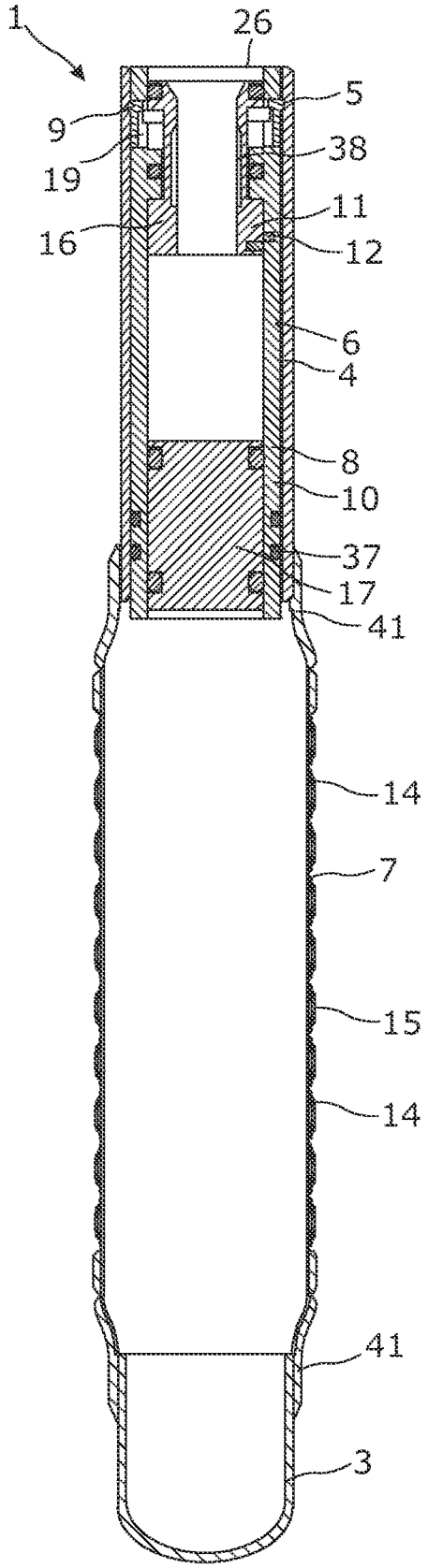
Figure 3D:
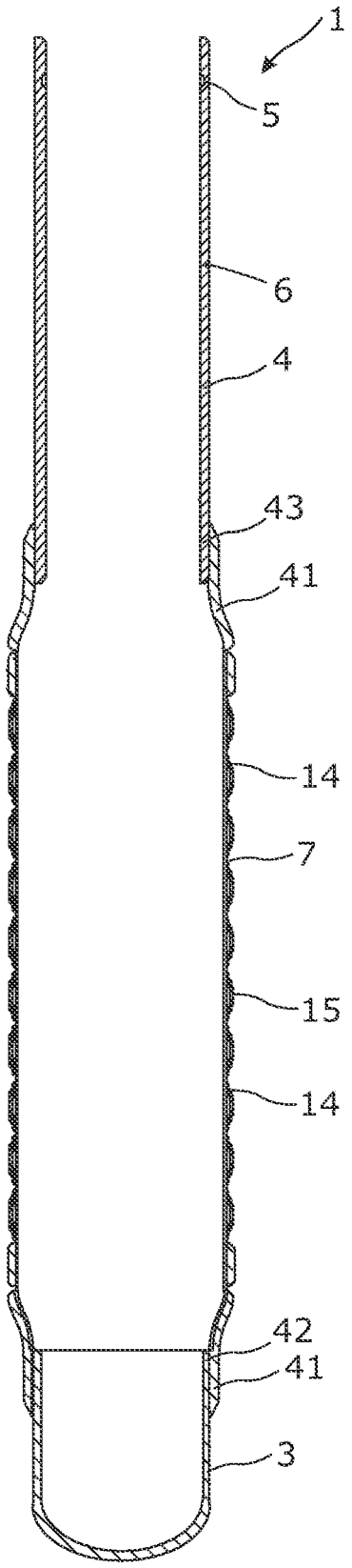
Figures 4A, 4B, 4C, 5A, 5B:
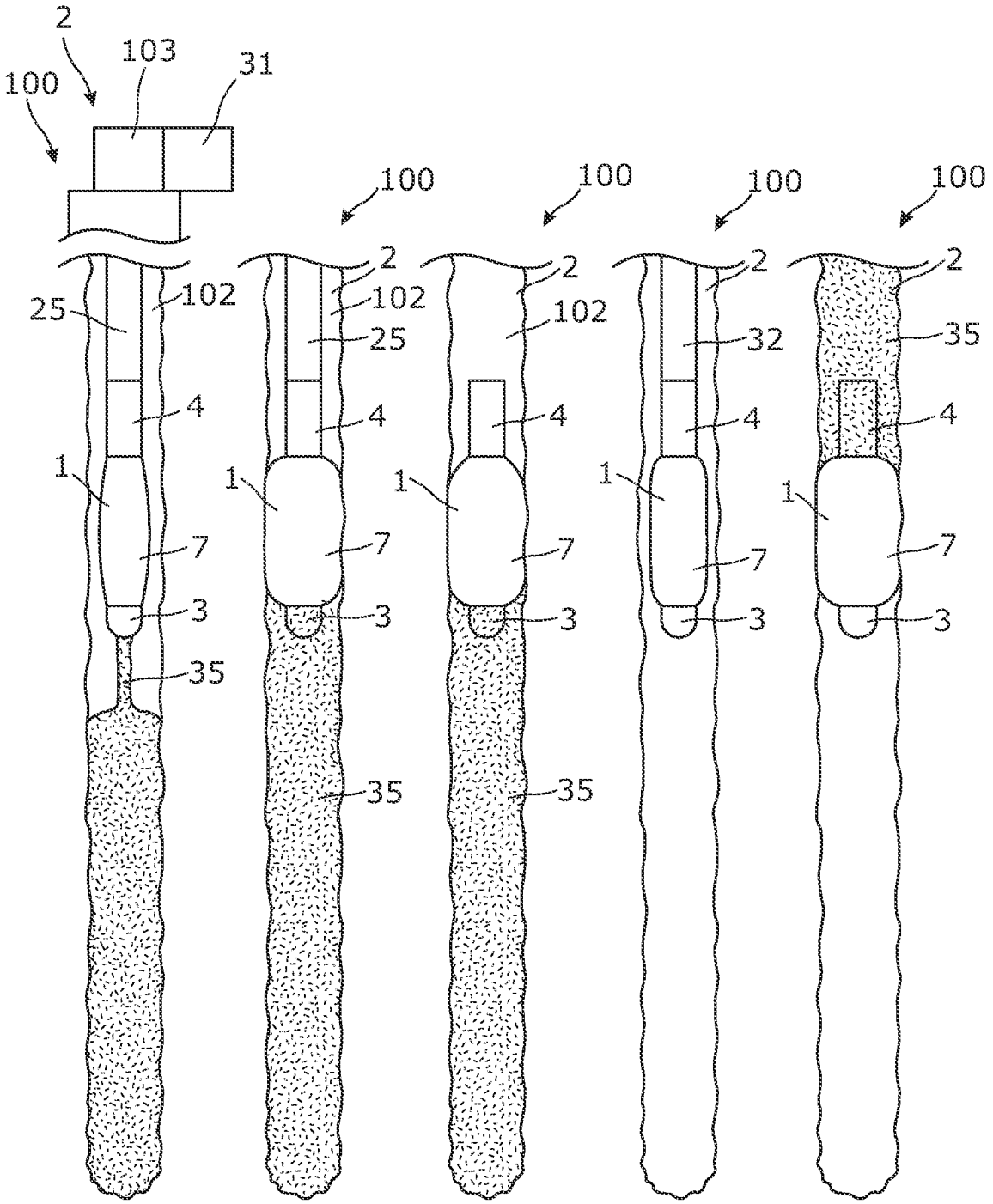
Figure 6A:
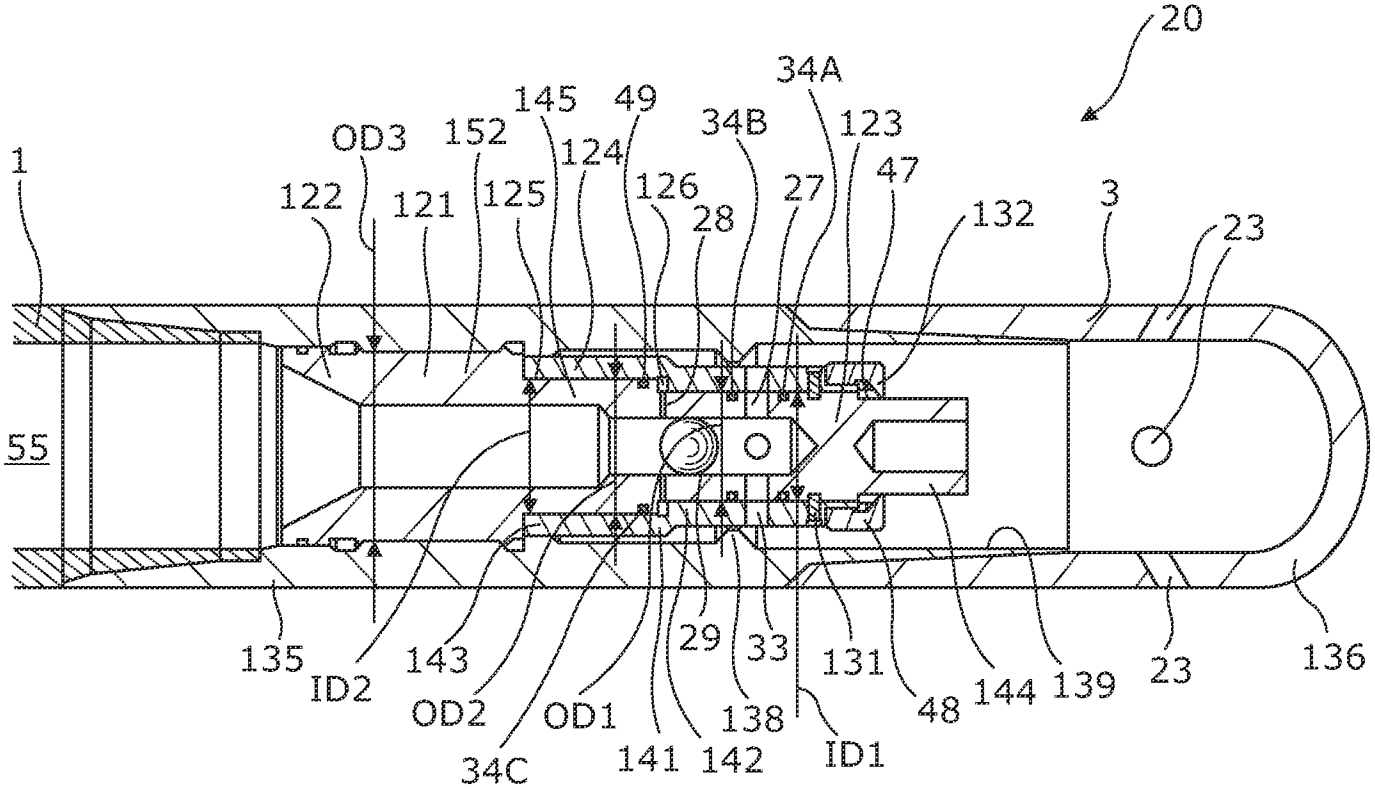
Figure 6B:
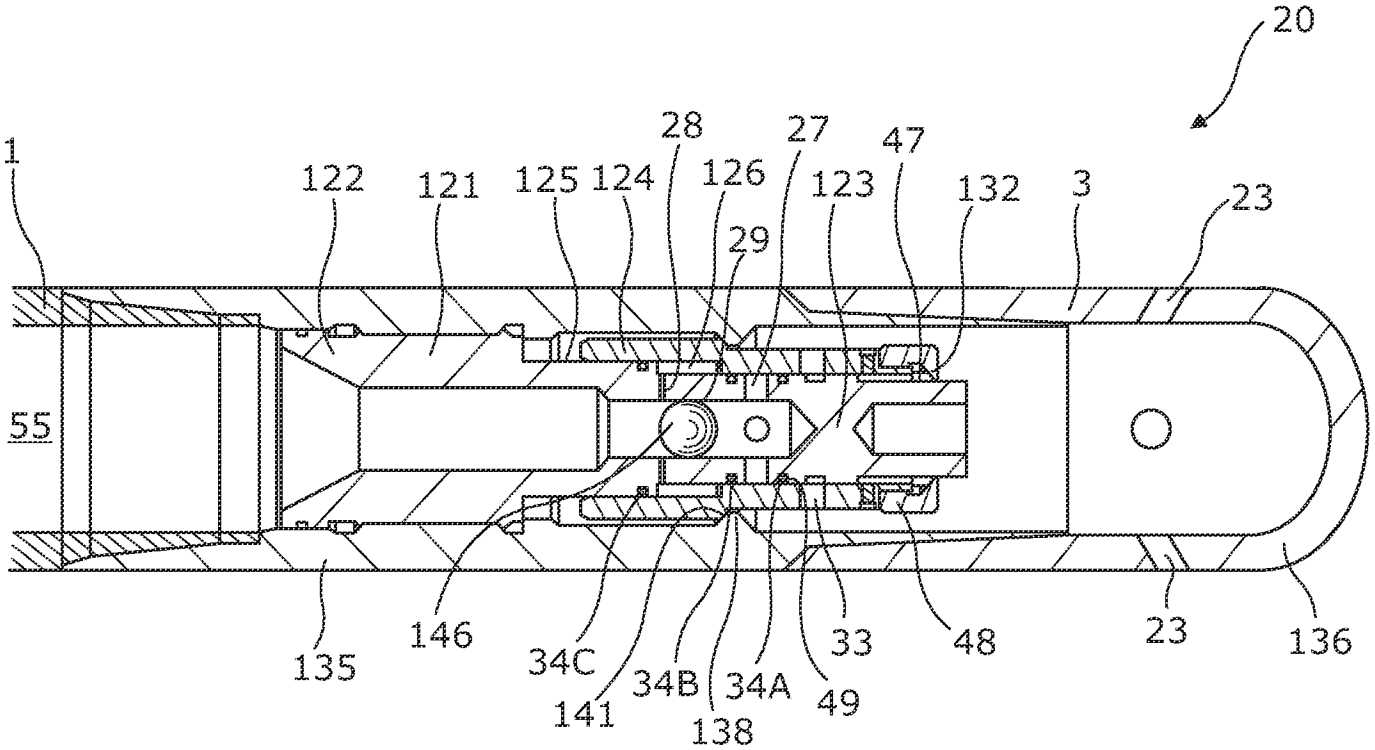
Figure 7A:
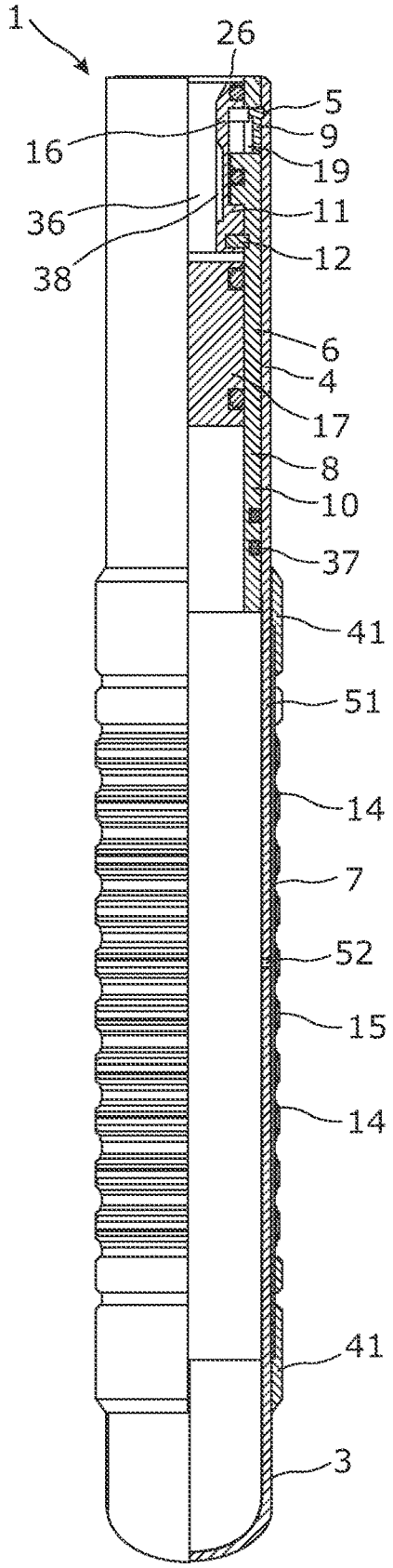
Figure 7B:
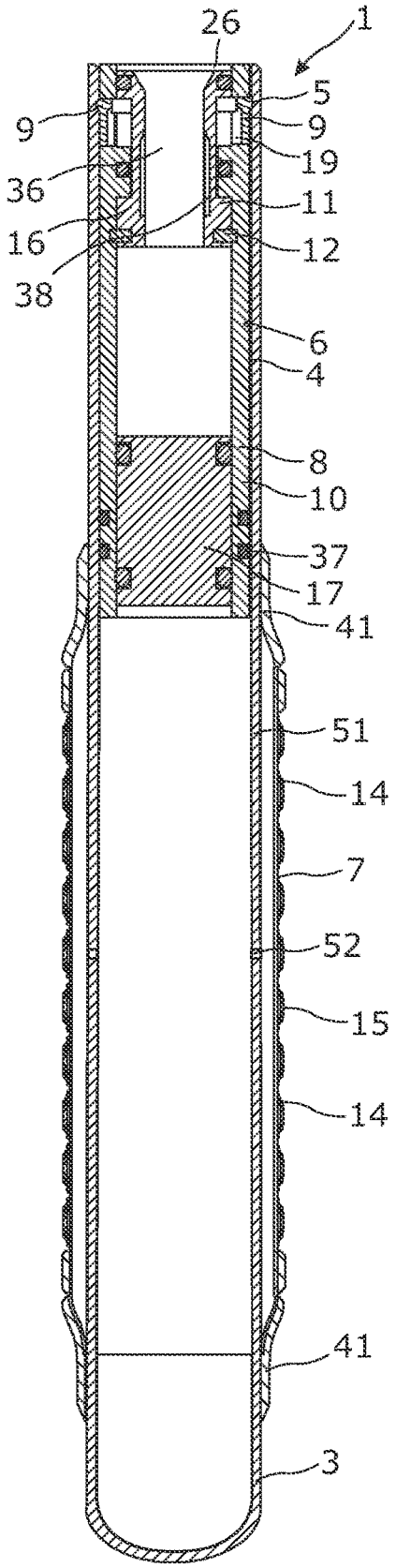

The invention and its many advantages will be described in more detail below with reference to the accompanying schematic drawings, which for the purpose of illustration show some non-limiting embodiments and in which:

FIGS. 1*a*-1*e* show a cross-sectional view of an abandonment plug before, during and after setting of the plug, FIGS. 2*a*-2*e* show a cross-sectional view of another abandonment plug before, during and after setting of the plug, FIGS. 3*a*-3*d* show a cross-sectional view of another abandonment plug before, during and after setting of the plug, FIGS. 4*a*-4*c* show a plug and abandonment system during cementing through drill pipe, expansion of the plug and after the plug and cement are installed, FIGS. 5*a* and 5*b* show a plug and abandonment system having a stroking tool during expansion of the plug and installation of cement, FIGS. 6A and 6B show a cross-sectional view of another abandonment plug before and during setting of the plug, and FIGS. 7A and 7B show a cross-sectional view of another abandonment plug before and after setting of the plug.

All the figures are highly schematic and not necessarily to scale, and they show only those parts which are necessary in order to elucidate the invention, other parts being omitted or merely suggested.

FIG. 1*a* shows an abandonment plug 1 for plug and abandonment of a well. The abandonment plug 1 comprises a first end part 3 being closed and forming a bottom of the plug, and a second end part 4 being tubular and having a groove 5 in its inner face 6. The second end part is closest to the top of the well. The abandonment plug 1 further comprises an expandable metal sleeve 7 arranged between the end parts, so that the expandable metal sleeve is the only element connecting the first end part and the second end part. The end parts 3, 4 are more rigid than the expandable metal sleeve 7, so that when a pressurised fluid is applied, the expandable metal sleeve is radially expanded to permanently deform and conform to the borehole wall or to a well tubular metal structure, thereby forming a plug therein. The abandonment plug 1 furthermore comprises a unit 8 which is releasably connected within the second tubular end part. The unit comprises at least one radially projectable fastening element 9, a unit sleeve 10 and a piston 11 movable within the unit sleeve. The piston 11 moves between a first position, shown in FIGS. 1*a* and 1*b*, in which the piston 11 forces the radially projectable fastening element 9 radially outwards in engagement with the groove 5, and a second position, shown in FIGS. 1*c*-1*e*, in which the piston is offset in relation to the radially projectable fastening element 9, allowing the radially projectable fastening element to move radially inwards.

The abandonment plug 1 has length of less than 5 metres, preferably less than 3 metres. The abandonment plug 1 is typically arranged in a well tubular metal structure for stopping cement being poured into the well for providing a cement plug being 50-100 metres long.

Figure 1B:
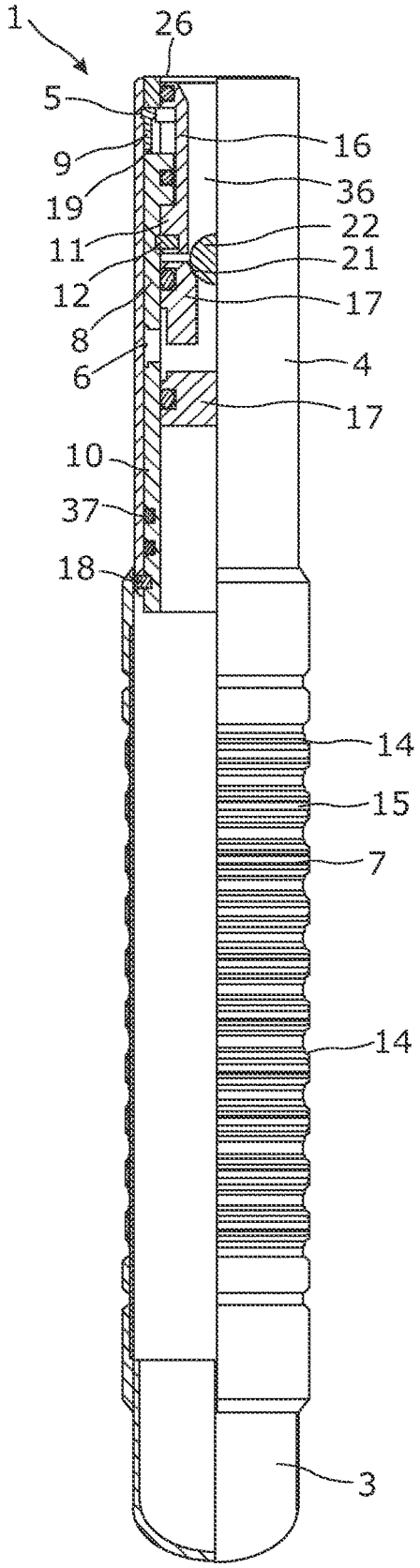
Figure 1C:
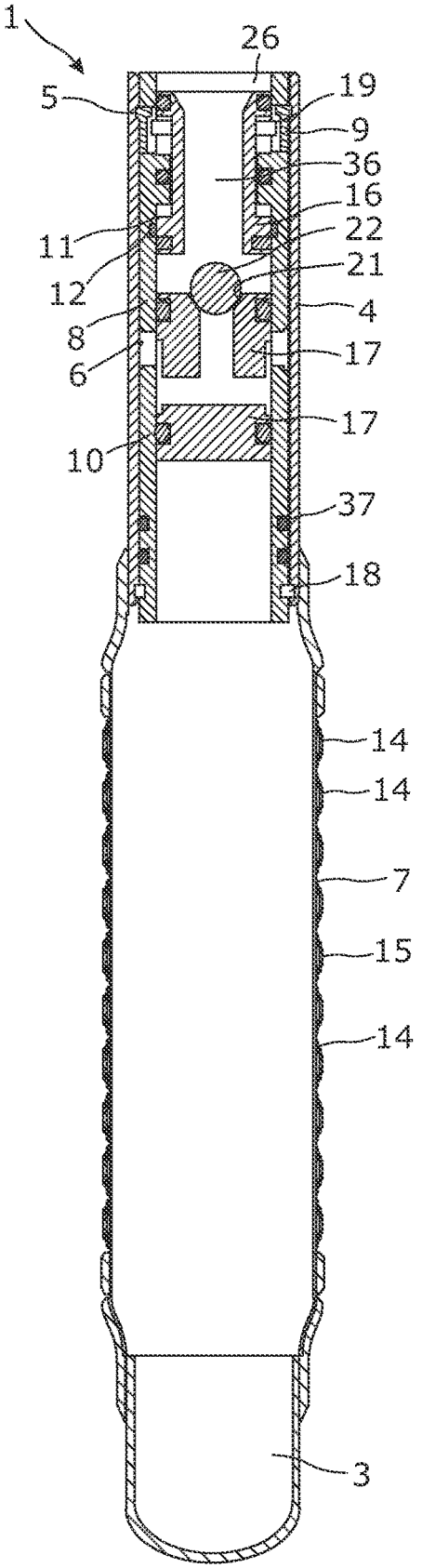
Figure 1D:
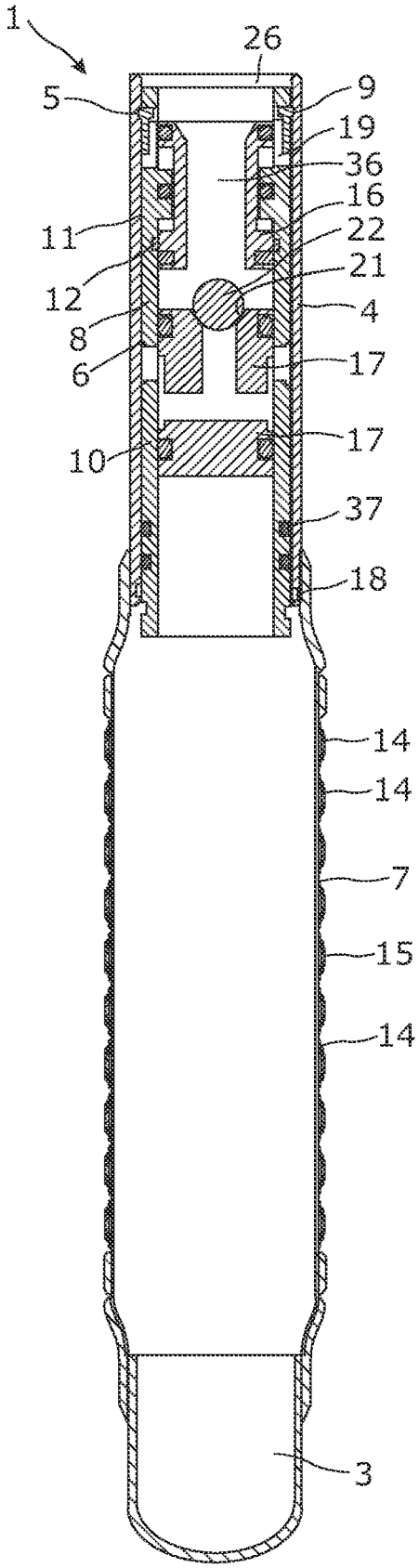

In FIG. 1*a*, the piston 11 has a first piston part 16 and a second piston part 17. The first piston part 16 and the second piston part 17 are separate pistons capable of moving in relation to each other. After the ball is dropped as shown in FIG. 1*b*, the second piston part 17 is able to move downwards, and the fluid under the ball expands the expandable metal sleeve 7, as shown in FIG. 1*c*. The abandonment plug 1 further comprises a first breakable element 12 for maintaining the first piston part 16 of the piston 11 in the first position, shown in FIGS. 1*a*-1*b*, in relation to the unit sleeve 10 until the breakable element 12 breaks at a predetermined force applied by a pressure difference between the annulus pressure acting on the first piston part 16 at the unit groove 19 and the expansion pressure inside the first piston part acting on a piston flange 44 below sealing element 37B, as shown in FIG. 1*c*. By a further increase in pressure, the piston 11 and the unit sleeve 10 move downwards releasing the unit sleeve by breaking a second breakable element 18, as shown in FIG. 1*d*, and the unit 8 is then retracted from the well as shown in FIG. 1*e*.

Figure 1E:
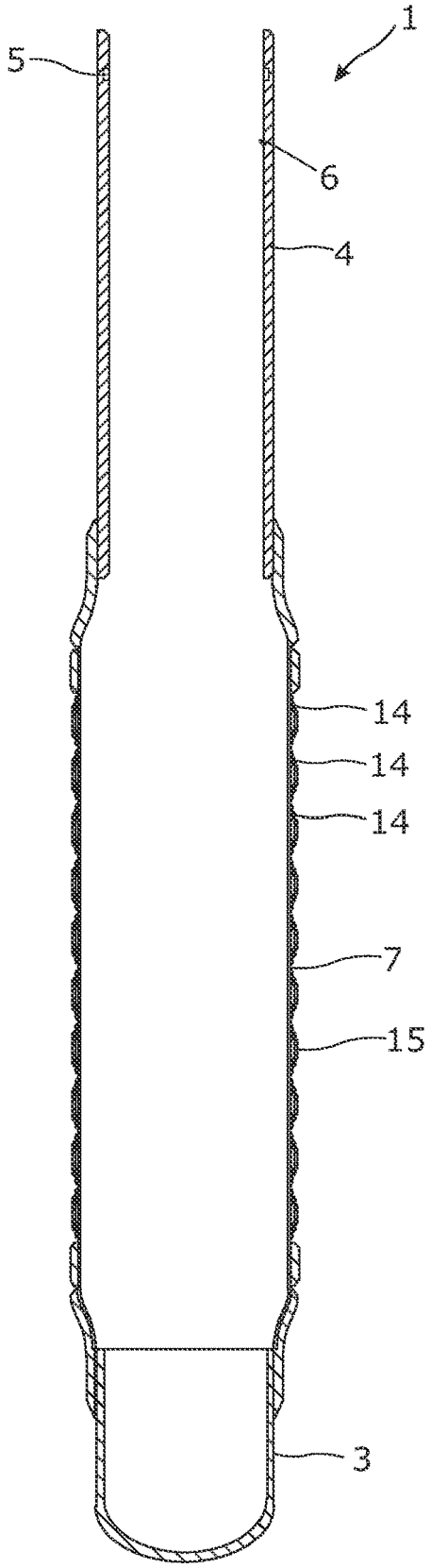

As can be seen in FIG. 1*e*, the expandable metal sleeve 7 is mounted end-to-end to the first and second end parts 3, 4, so that the expandable metal sleeve 7 is the only element connecting the first end part 3 and the second end part 4. The unit has been released and pulled out and the plug is ready for being filled with cement to place cement above the plug 1. The expandable metal sleeve 7 has circumferential projections 14 and a sealing element 15 arranged between two projections to better seal against the borehole or within a well tubular metal structure.

By only relying on simple mechanical functions such as breaking a shear pin to expand the abandonment plug 1 and then pull out the unit 8, no complex structure can get stuck and hinder the plug and abandonment. The plug left in the well is very simple but sufficient to hold the cement until it cures. When running the plug in, the fluid can easily pass the plug and no advanced flow-through is required since the cement is applied on top of the set plug. If for some reason, the plug is expanded but the unit is not released, the unit can just remain in the well and be part of the plug being filled with cement.

The abandonment plug 1 is typically connected to a workover pipe, drill pipe (a drill pipe string), coiled tubing or similar disconnectable tubing in order to provide pressurised fluid from surface to expand the abandonment plug 1 and disconnect when the plug has been set. In another embodiment, the abandonment plug 1 is connected to a wireline tool having a pump for providing the pressurised fluid.

The piston 11 is tubular provided by a bore 36 and thus has a very simple design. The piston of FIGS. 1*a*-1*d* has a first piston part 16 and a second piston part 17 which are movable in relation to each other. The first piston part 16 is tubular so that the ball can flow past, and the second piston part is bore-less so that the ball 22 can seat in a ball seat 21 in the second piston part 17 and the second piston part functions as the piston 11 enabling expansion of the expandable metal sleeve 7.

The abandonment plug 1 further comprises the second breakable element 18 between the unit sleeve 10 and the second end part 4 as a safety precaution for maintaining the unit sleeve in the first position in relation to the second end part during expansion of the expandable metal sleeve until the second breakable element 18 breaks at a predetermined force. However, the second breakable element is easy to break by applying a downward force on the unit sleeve 10, e.g. by increasing the pressure, and the unit 8 can thus always be easily retracted. The unit sleeve 10 of FIG. 1*a* has a unit groove 19 in which the radially projectable fastening element 9 is arranged. The unit sleeve 10 further comprises sealing elements 37 arranged between the unit sleeve 10 and the second end part 4.

The abandonment plug 1 of FIGS. 2*a*-2*e* has an opening 23 in the first end part 3 for receiving a wiper dart 24 (or a ball) to close the first end part. By having an opening 23 in the first end part, cement can be injected below the plug 1 before the expandable metal sleeve 7 is expanded and the plug set. After the cement has been applied through the opening 23, a wiper dart 24 is dropped and seats in the first end part 3, as shown in FIG. 2*b*, closing the first end part 3. Subsequently, cement can be applied through a drill pipe string of drill pipe connected to the plug, and the expandable metal sleeve 7 is expanded as shown in FIG. 2*c*. In this step, the first breakable element 12 is broken by the piston 11 moving slightly downwards, so that the radially projectable fastening element 9 is free to move radially inwards. This is due to the same pressure difference over the first piston part 16, as described in relation to FIG. 1*a*-1*e*. By continuing the pressure increase, the piston 11 and the unit sleeve 10 is moved downwards, breaking also the second breakable element 18, and the drill pipe/drill pipe string can be retracted together with the unit 8, as shown in FIG. 2*e*, while pumping cement down the drill pipe and the unit which then is applied above the plug if requested by the operator. The plug 1 can thus be set in the middle of a cemented zone to contribute to the curing process in the intended position as this plug 1 can be applied with cement under, in and above the plug. In FIGS. 2*a*-2*d*, the piston 11 is one part only moving from the first position to the second position.

In FIGS. 6A and 6B, the opening 23 in the first end part 3 of the abandonment plug 1 of FIGS. 2*a*-2*e* is closed by a closing unit 20 instead of the wiper dart. The closing unit 20 has a first position shown in FIG. 6A and a second position shown in FIG. 6B. In the first position, the closing unit is configured to allow flow through the first end part 3 and in the second position the closing unit is configured to close the first end part 3. The closing unit 20 comprises a tubular unit part 121 having a first unit end 122 being open and being in fluid communication with the inside 55 of the abandonment plug 1.

As shown in FIGS. 6A and 6B, the tubular unit part has a second unit end 123 which is closed. The closing unit further comprises a sliding sleeve 124 arranged on an outer face 125 of the tubular unit part defining a chamber 126 there between. The tubular unit part 121 further comprises at least one first opening 27 and at least one second opening 28 arranged opposite the chamber 126. The at least one second opening is arranged closer to the first unit end than the at least one first opening. The closing unit further comprises a ball seat 29 arranged in the tubular unit part between the first openings and the second openings for receiving a ball. When the abandonment plug 1 is run in hole, the closing unit in its first position allows flow-through, meaning that the well fluid surrounding the abandonment plug 1 is allowed to enter the first end part 3 of the abandonment plug 1 through apertures 23 in an end cap 136, as shown in FIG. 6A.

Thus in the first position, the sliding sleeve 124 uncovers the first openings and in the second position, the sliding sleeve covers the first openings and thereby closes the end of the abandonment plug 1. The sliding sleeve 124 moves from the first position to the second position by dropping the ball and by means of fluid entering the chamber 126 through the second opening 28 and presses onto the sliding sleeve, increasing the chamber 126 as the sliding sleeve moves away from the first unit end 122 towards the second unit end 123. Thus, the sliding sleeve functions as a piston. The ball blocks the second opening so that fluid is led into the chamber 126.

As can be seen in FIG. 6A, the closing unit comprises a shear pin 131 for maintaining the sliding sleeve in the first position until a predetermined pressure is reached on the inside 55 of the abandonment plug 1 and presses onto the sliding sleeve, breaking the shear pin and thus, the sliding sleeve starts to move to the second position, as shown in FIG. 6B.

In order to prevent the closing unit from returning to the first position but still remain closed, the outer face at the second unit end comprises circumferential grooves 47 engaging a pawl 132 of an end part 48 of the sliding sleeve 124 in the form of a ratchet system. In another embodiment, collets may be released as the sliding sleeve moves and the collets falling into the space created behind the sliding sleeve as it moves towards the second position and thus hinders the sliding sleeve from returning to the first position.

In FIG. 6A, the sliding sleeve may comprise an opening 33 which in the first position is aligned with the first opening 27 in the tubular unit part 121 and thus uncovers the first opening. In another embodiment, the sliding sleeve does not overlap the first opening 27 in the first position but covers the first opening in the second position.

In order to properly seal off the first opening, the closing unit 20 further comprises a first sealing means 34A and a second sealing means 34B arranged between the sliding sleeve 124 and the tubular unit part 121 on each side of the first opening. In FIG. 6A, the first sealing means 34A and the second sealing means 34B are arranged in circumferential grooves 49 in the tubular unit part 121. In order to provide a reliable sliding of the sliding sleeve 124, the closing unit 20 further comprises a third sealing means 34C arranged between the sliding sleeve 124 and the tubular unit part 121 between the first unit end 122 and the second opening 28.

In FIGS. 6A-6B, the closing unit 20 further comprises a unit housing 135 surrounding the tubular unit part 121 and the sliding sleeve 124 so that the sliding sleeve slides between the unit housing 135 and the tubular unit part 121.

The unit housing 135 may comprise a projection 138 on an inner face 139 for receiving a flange 141 of the tubular unit part so that the tubular unit part 121 is hindered from movement past the projection 138 and past the first opening 27. In this way, it is ensured that the sliding sleeve does not slide too far and thus it is ensured that it uncovers the first opening 27 again. As can be seen in FIGS. 6A-6B, the second opening has a diameter smaller than that of the at least one first opening.

The sliding sleeve has a first sleeve part 142 having a first inner sleeve diameter ID1 and a second sleeve part 143 having a second inner sleeve diameter ID2, and the tubular unit part 121 has a first unit section 144 having a first outer diameter OD1 corresponding to the first inner sleeve diameter ID1 and a second unit section 145 of the tubular unit part 121 having a second outer diameter OD2 corresponding to the second inner sleeve diameter ID2. The first inner sleeve diameter is smaller than the second inner sleeve diameter providing possibility for creating the chamber 126.

The tubular unit part 121 has a third unit section 152 having a third outer diameter OD3 being greater than the second outer diameter OD2. The third outer diameter OD3 being greater than the outer diameter of the second sleeve part 143 creating space for the second sleeve part to be allowed to slide until reaching the projection 138. The outer diameter of the first sleeve part 142 is smaller than the inner diameter of the projection so that the first sleeve part 142 is allowed to freely slide past the projection.

The tubular unit part may have a decreasing inner diameter from the open end at the first unit end towards the ball seat for guiding a ball 146 towards the ball seat.

The tubular unit part may be mounted within the unit housing as shown in FIGS. 6A-6B, but in another embodiment, the unit housing and the tubular unit part are combined into one part, having an elongated groove in which the sliding sleeve slides. The closing unit may function without the unit housing or without an outer part surrounding the sliding sleeve 124 as the sleeve just pushes any elements away from the outer face of the tubular unit part 121 when the sleeve slides towards the second position.

In FIG. 3*a*, the unit sleeve 10 has a through-bore 26 in which the piston 11 slides as in FIGS. 1*a*-1*d* and FIGS. 2*a*-2*d*. The unit sleeve 10 of the abandonment plug 1 of FIGS. 3*a*-3*d* is connected to a housing of a stroking tool 32 (shown in FIG. 5*a*). The stroking tool has a stroking shaft which in a first downward stroke pushes the second piston part 17 downwards to expand the expandable metal sleeve 7 by the enclosed fluid below the second piston part 17. In a second stroke, the stroking tool engages the grooves 38 (shown in FIG. 3*a*) in the tubular piston 11 and moves the first piston part 16 downwards breaking the breakable element 12. In another embodiment the stroking tool may provide a pressurised fluid to move the second piston part 17, as shown in FIG. 3*b*, in order to expand the expandable metal sleeve 7. The stroking tool then provides a further downward stroke to displace the piston 11 and the unit sleeve 10 downwards, breaking the second breakable element, i.e. a shear pin 18, and releasing the unit 8 from the second end part 4, as shown in FIG. 3*c*, and retracting the tool, as shown in FIG. 3*d*.

Sealing means 37 are provided in different places, as shown in FIGS. 1*a*-3*d*, for ensuring a sufficient seal between moving parts of the abandonment plug 1. As shown in FIG. 3*d*, the expandable metal sleeve 7 is mounted by means of connection parts 41 to an end 42 of the first end part 3 and to an end 43 of the second end part 4. Thus, the connection parts overlap the ends 42, 43 connecting the expandable metal sleeve 7 end to end to the first and second end parts 3, 4.

In FIGS. 4*a*-4*c*, a plug and abandonment system 100 is shown in a well 2 comprising the abandonment plug and a cement supply 31 for supplying cement above the plug, below the plug and/or in the plug depending on what plug solution is chosen. The plug and abandonment system 100 is arranged in a borehole 102 by means of drill pipe 25 or similar disconnectable tubing from a top 103 of the well.

In FIGS. 5*a*-5*b*, the plug and abandonment system 100 is shown in a well 2 and comprises a stroking tool 32 connected to the unit for providing an axial force for expanding the expandable metal sleeve 7, as shown in FIG. 5*b*, where the unit 8 has been withdrawn, and cement 35 is applied above the plug 1.

The first end part 3 and the second end part 4 may also be connected as shown in FIGS. 7*a* and 7*b*, so that there is a base part 51 underneath the expandable metal sleeve 7. By having such base pipe 51 connecting the first end part 3 and the second end part 4, the abandonment plug 1 is significantly stronger in the longitudinal extension of the plug. The base part 51 has an opening 52 for letting fluid into an annular space between the base part and the expandable metal sleeve 7.

A stroking tool 32 is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By an annular barrier is meant an annular barrier comprising a tubular metal part mounted as part of the well tubular metal structure and an expandable metal sleeve surrounding and connected to the tubular part defining an annular barrier space.

By a casing or a well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A plug for plugging a well, said plug comprising:
- a first end part being closable or closed,
- a second end part being tubular and having a groove in an inner face,
- an expandable metal sleeve arranged between the end parts, the end parts being more rigid than the expandable metal sleeve,
- a unit releasably connected to the second tubular end part whilst the metal sleeve is expanded, the unit comprising:
  - at least one radially projectable fastening element,
  - a unit sleeve, and
  - a piston movable in the unit sleeve for, in a first position, forcing the radially projectable fastening element radially outwards in engagement with the groove during expansion of the metal sleeve and, in a second position, being offset in relation to the radially projectable fastening element, allowing the radially projectable fastening element to move radially inwards; and
- a first breakable element for maintaining the piston in the first position in relation to the unit sleeve until the first breakable element breaks at a predetermined force.

2. The plug according to claim 1, wherein the expandable metal sleeve is mounted end-to-end to the first and second end parts.

3. The plug according to claim 1, wherein the piston is tubular.

4. The plug according to claim 1, wherein the piston has a first piston part and a second piston part which are movable in relation to each other.

5. The plug according to claim 4, wherein the first piston part is tubular and the second part is bore-less.

6. The plug according to claim 1, further comprising a second breakable element between the unit sleeve and the second end part.

7. The plug according to claim 1, wherein the unit sleeve has a unit groove in which the radially projectable fastening element is arranged.

8. The plug according to a claim 1, wherein the piston has a ball seat for receiving a ball dropped into the well.

9. The plug according to claim 1, wherein the first end part has an opening for receiving a wiper dart or ball to close the first end part.

10. The plug according to claim 1, wherein the plug is configured to be connected to a workover pipe, drill pipe, coiled tubing or disconnectable tubing.

11. The plug according to claim 1, wherein the unit sleeve has a through-bore in which the piston slides.

12. Plug and abandonment system comprising the plug according to claim 1 and a cement supply for supplying cement above the plug, below the plug and/or in the plug.

13. Plug and abandonment system according to claim 12, further comprising a stroking tool connected to the unit for providing an axial force for expanding the expandable metal sleeve.

14. Plug and abandonment system according to claim 12, further comprising disconnectable tubing connecting the cement supply with the plug.

15. A plug for plugging a well, said plug comprising:
- a first end part being closable or closed,
- a second end part being tubular and having a groove in an inner face,
- an expandable metal sleeve arranged between the end parts, the end parts being more rigid than the expandable metal sleeve, and
- a unit releasably connected to the second tubular end part whilst the metal sleeve is expanded, the unit comprising:
  - at least one radially projectable fastening element,
  - a unit sleeve, and
- a piston movable in the unit sleeve for, in a first position, forcing the radially projectable fastening element radially outwards in engagement with the groove during expansion of the metal sleeve and, in a second position, being offset in relation to the radially projectable fastening element, allowing the radially projectable fastening element to move radially inwards,
- wherein the unit sleeve is sealed against an inner surface of the second end part, and the piston is sealed against an inner surface of the unit sleeve, thus closing the second end part.

16. The plug according to claim 15, wherein a part of the piston that spans the entire unit sleeve is boreless, thereby defining a confined fluid space such that when subject to pressurized fluid, the piston translates to compress the confined fluid space to expand the expandable metal sleeve.

17. A plug for plugging a well, said plug comprising:
- a first end part being closable or closed,
- a second end part being tubular and having a groove in an inner face,
- an expandable metal sleeve arranged between the end parts, the end parts being more rigid than the expandable metal sleeve, and
- a unit releasably connected to the second tubular end part whilst the metal sleeve is expanded, the unit comprising:

at least one radially projectable fastening element, a unit sleeve, and a piston movable in the unit sleeve for, in a first position, forcing the radially projectable fastening element radially outwards in engagement with the groove during expansion of the metal sleeve and, in a second position, being offset in relation to the radially projectable fastening element, allowing the radially projectable fastening element to move radially inwards, wherein the piston has a first piston part and a second piston part which are movable in relation to each other.

* * * * *